US011039730B2

(12) United States Patent
Brewer et al.

(10) Patent No.: US 11,039,730 B2
(45) Date of Patent: Jun. 22, 2021

(54) DISHWASHING APPLIANCE WITH MOISTURE-RESISTANT CAPACITIVE TOUCH SENSOR

(71) Applicant: Haier US Appliance Solutions, Inc., Wilmington, DE (US)

(72) Inventors: Kyle James Brewer, Louisville, KY (US); Brian Steven Riddle, Taylorsville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 300 days.

(21) Appl. No.: 16/264,871

(22) Filed: Feb. 1, 2019

(65) Prior Publication Data

US 2020/0245843 A1 Aug. 6, 2020

(51) Int. Cl.
*A47L 15/42* (2006.01)

(52) U.S. Cl.
CPC ..... *A47L 15/4293* (2013.01); *A47L 15/4257* (2013.01); *A47L 15/4274* (2013.01)

(58) Field of Classification Search
CPC ..... A47L 15/4293
See application file for complete search history.

(56) References Cited

U.S. PATENT DOCUMENTS 8,503,169 B2 8/2013 Byrne et al.
2011/0181516 A1 7/2011 Mallory et al.

FOREIGN PATENT DOCUMENTS

DE 202011110179 U1 5/2013

*Primary Examiner* — Jason Y Ko
(74) *Attorney, Agent, or Firm* — Dority & Manning, P.A.

(57) ABSTRACT

A dishwashing appliance includes a cabinet and a tub in the cabinet. The tub defines a wash chamber for receipt of articles for washing. A door is rotatably mounted to the cabinet for movement between a closed position wherein the wash chamber is sealingly enclosed and an open position permitting access to the wash chamber for loading and unloading of articles from the dishwashing appliance. The dishwashing appliance also includes a control console positioned on the door. The control console includes a console cover on an exterior surface of the door, a console bracket mounted within an interior of the door and proximate the console cover, and a circuit board attached to an interior surface of the console cover with a double-sided adhesive film. The double-sided adhesive film sealingly engages the console cover and the console bracket.

18 Claims, 3 Drawing Sheets

DISHWASHING APPLIANCE WITH MOISTURE-RESISTANT CAPACITIVE TOUCH SENSOR

FIELD

The present subject matter relates generally to user inputs for appliances, such as touch sensors for dishwashing appliances.

BACKGROUND

Appliances generally include a control panel having a plurality of buttons, keys, or other input devices. Utilizing the control panel, an appliance user can input control commands to the appliance and operate the appliance. Certain control panels include capacitive touch sensors that utilize a user's body capacitance to operate. In particular, capacitive touch sensors can detect a change in capacitance when the user touches the control panel.

Capacitive touch sensors have various benefits. For example, capacitive touch sensors can assist with providing a clean appearance for an associated appliance. In particular, capacitive touch sensors are frequently positioned behind a dielectric panel. A user touches an outer surface of the dielectric panel opposite the capacitive touch sensors to actuate the capacitive touch sensors. The smooth outer surface can have a pleasant cosmetic appearance, e.g., particularly compared to tactile buttons, knobs, etc.

Some capacitive touch sensors can register a "false touch," e.g., when something other than the user touches the sensors or the dielectric panel such capacitive touch sensors may be actuated in an undesirable manner. For example, water or other liquids splashed or spilled on the control panel may cause capacitive touch sensors of the control panel to register a false touch.

Dishwashing appliances generally include a tub that defines a wash chamber. Rack assemblies can be mounted within the wash chamber for receipt of articles for washing. Various cycles may be included as part of the overall cleaning process. For example, a typical, user-selected cleaning option may include a wash cycle and rinse cycle (referred to collectively as a wet cycle), as well as a drying cycle. In addition, spray-arm assemblies within the wash chamber may be used to apply or direct fluid towards the articles disposed within the rack assemblies in order to clean such articles. As is generally understood, dishwashing appliances may often include multiple spray-arm assemblies, such as a lower spray-arm assembly mounted to the tub at a bottom of the wash chamber, a mid-level spray-arm assembly mounted to one of the rack assemblies, and/or an upper spray-arm assembly mounted to the tub at a top of the wash chamber.

While it is desirable to incorporate a capacitive touch sensor or sensors in a dishwashing appliance for the above-noted reasons, it is also challenging to do so given the presence of water and other liquids utilized by such appliances, e.g., during a wash cycle and/or rinse cycle, as mentioned above.

Accordingly, an improved capacitive touch sensor for an appliance would be welcomed, in particular, a capacitive touch sensor with improved resistance to moisture, e.g., water and/or wash liquids, for use in a dishwashing appliance would be welcomed.

BRIEF DESCRIPTION

Aspects and advantages of the invention will be set forth in part in the following description, or may be obvious from the description, or may be learned through practice of the invention.

In one aspect, the present subject matter is directed to a dishwashing appliance. The dishwashing appliance includes a cabinet and a tub in the cabinet. The tub defines a wash chamber for receipt of articles for washing. A door is rotatably mounted to the cabinet for movement between a closed position wherein the wash chamber is sealingly enclosed and an open position permitting access to the wash chamber for loading and unloading of articles from the dishwashing appliance. The dishwashing appliance also includes a control console positioned on the door. The control console includes a console cover on an exterior surface of the door, a console bracket mounted within an interior of the door and proximate the console cover, and a circuit board attached to an interior surface of the console cover with a double-sided adhesive film. The double-sided adhesive film sealingly engages the console cover and the console bracket.

In another aspect, the present subject matter is directed to a dishwashing appliance. The dishwashing appliance includes a cabinet. The cabinet defines a vertical direction, a lateral direction, and a transverse direction that are mutually perpendicular. A tub is located in the cabinet. The tub defines a wash chamber for receipt of articles for washing. A door is rotatably mounted to the cabinet for movement between a closed vertical position wherein the wash chamber is sealingly enclosed and an open position permitting access to the wash chamber for loading and unloading of articles from the dishwashing appliance. The dishwashing appliance also includes a control console positioned on the door. The control console includes a console cover on an exterior surface of the door. The exterior surface of the door faces upward along the vertical direction when the door is in the closed position. The control console also includes a console bracket mounted within an interior of the door and below the console cover along the vertical direction when the door is in the closed position and a circuit board attached to an interior surface of the console cover with a double-sided adhesive film. The double-sided adhesive film sealingly engages the console cover and the console bracket.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
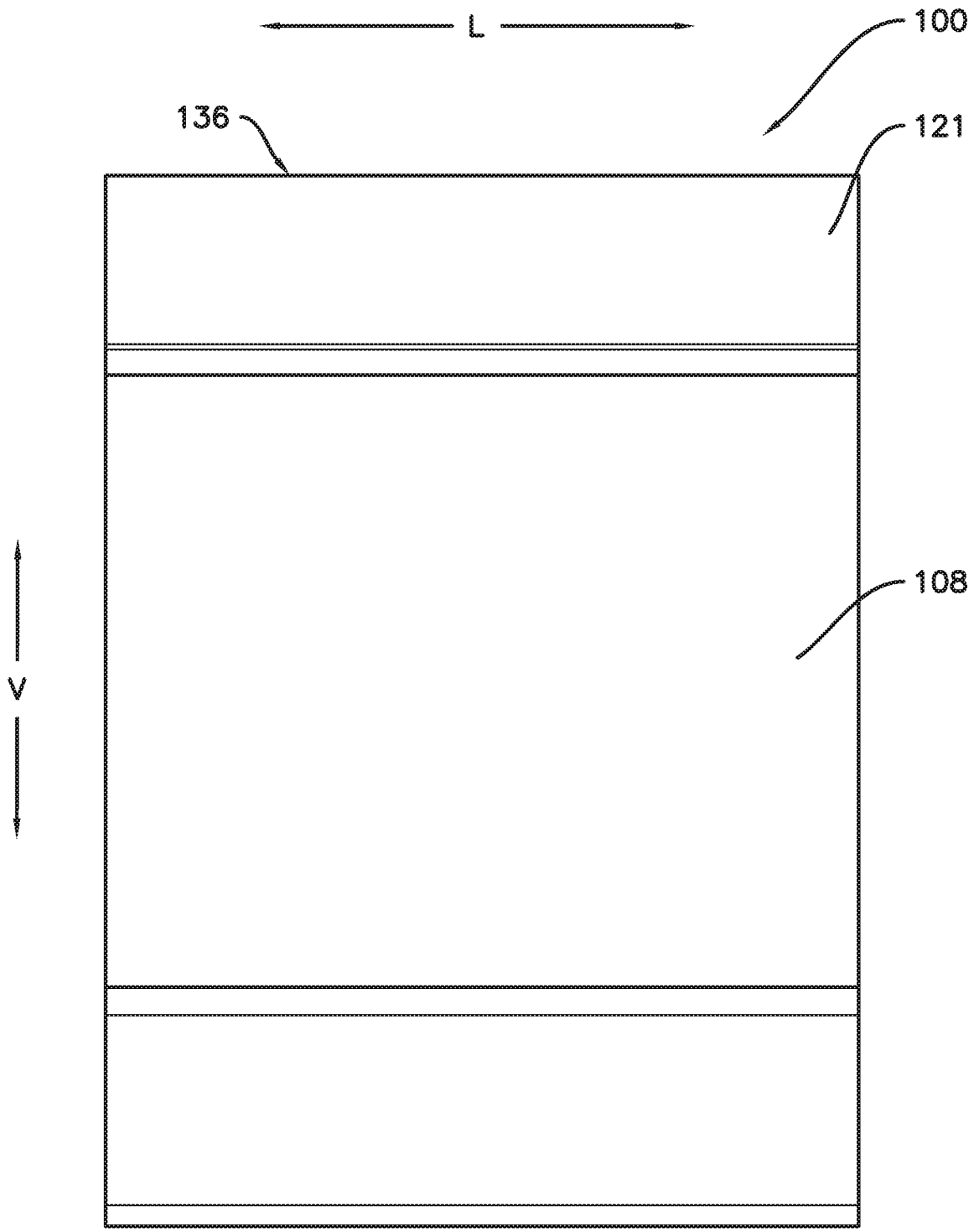
FIG. 1 illustrates a front view of one embodiment of a dishwashing appliance in accordance with aspects of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. As used herein, terms of approximation such as "generally," "about," or "approximately" include values within ten percent greater or less than the stated value. When used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

Figure 2:
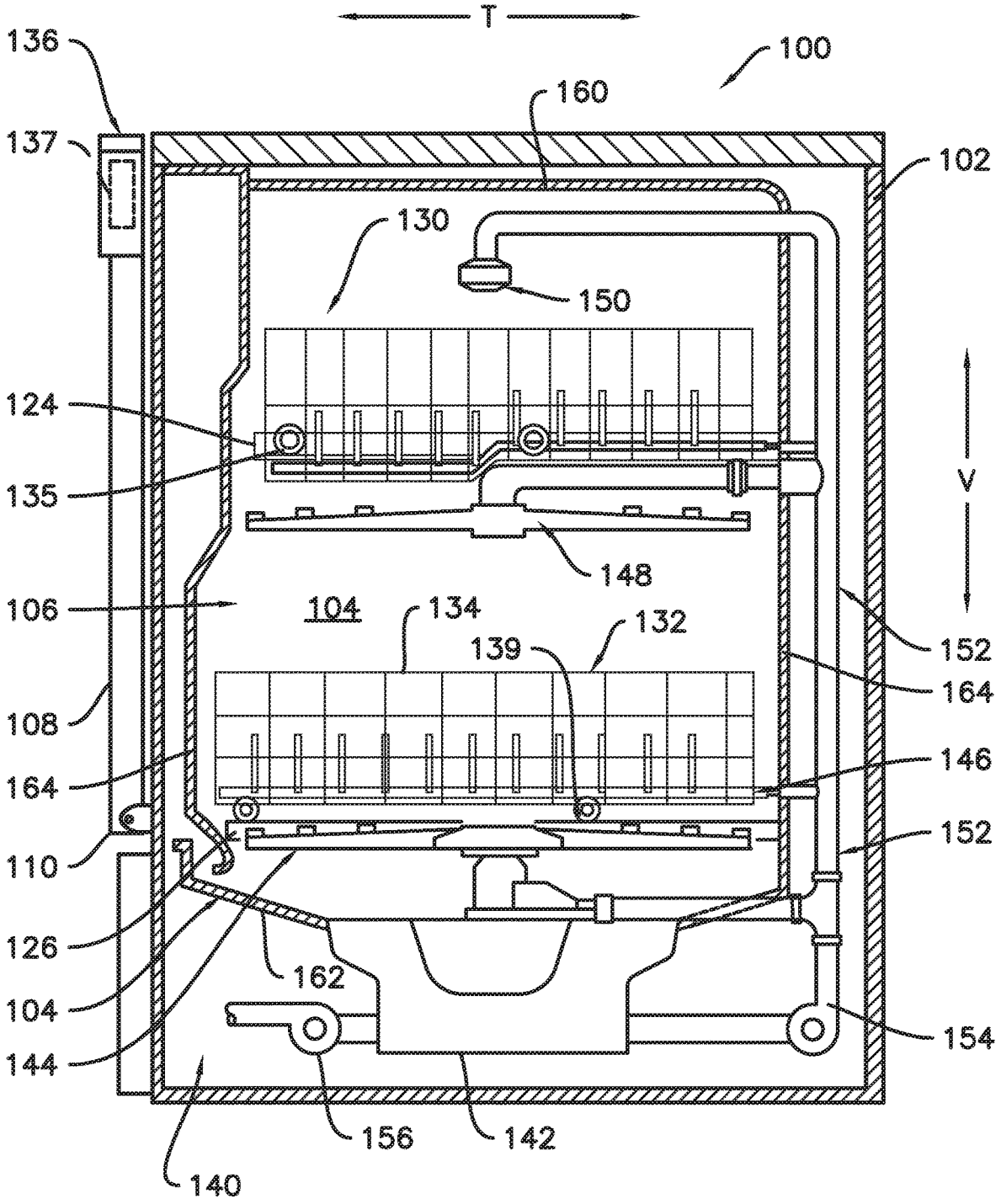
FIG. 2 illustrates a cross-sectional side view of the dishwashing appliance shown in FIG. 1, particularly illustrating various internal components of the dishwashing appliance.

Referring now to the drawings, FIGS. 1 and 2 illustrate one embodiment of a domestic dishwashing appliance 100 that may be configured in accordance with aspects of the present disclosure. As shown in FIGS. 1 and 2, the dishwashing appliance 100 may include a cabinet 102 having a tub 104 therein defining a wash chamber 106. The tub 104 may generally include a front opening (not shown) and a door 108 hinged at its bottom 110 for movement between a normally closed vertical position (shown in FIGS. 1 through 3), wherein the wash chamber 106 is sealed shut for washing operation, and a horizontal open position for loading and unloading of articles from the dishwashing appliance 100.

As is understood, the tub 104 may generally have a rectangular cross-section defined by various wall panels or walls. For example, as shown in FIG. 2, the tub 104 may include a top wall 160 and a bottom wall 162 spaced apart from one another along a vertical direction V of the dishwashing appliance 100. Additionally, the tub 104 may include a plurality of sidewalls 164 (e.g., four sidewalls) extending between the top and bottom walls 160, 162. It should be appreciated that the tub 104 may generally be formed from any suitable material. However, in several embodiments, the tub 104 may be formed from a ferritic material, such as stainless steel, or a polymeric material.

As particularly shown in FIG. 2, upper and lower guide rails 124, 126 may be mounted on opposing side walls 164 of the tub 104 and may be configured to accommodate roller-equipped rack assemblies 130 and 132. Each of the rack assemblies 130, 132 may be fabricated into lattice structures including a plurality of elongated members 134 (for clarity of illustration, not all elongated members making up assemblies 130 and 132 are shown in FIG. 2). Additionally, each rack 130, 132 may be adapted for movement along a transverse direction T between an extended loading position (not shown) in which the rack is substantially positioned outside the wash chamber 106, and a retracted position (shown in FIGS. 1 and 2) in which the rack is located inside the wash chamber 106. This may be facilitated by rollers 135 and 139, for example, mounted onto racks 130 and 132, respectively. As is generally understood, a silverware basket (not shown) may be removably attached to rack assembly 132 for placement of silverware, utensils, and the like, that are otherwise too small to be accommodated by the racks 130, 132.

Additionally, the dishwashing appliance 100 may also include a lower spray-arm assembly 144 that is configured to be rotatably mounted within a lower region 146 of the wash chamber 106 directly above the bottom wall 162 of the tub 104 so as to rotate in relatively close proximity to the rack assembly 132. As shown in FIG. 2, a mid-level spray-arm assembly 148 may be located in an upper region of the wash chamber 106, such as by being located in close proximity to the upper rack 130. Moreover, an upper spray assembly 150 may be located above the upper rack 130.

As is generally understood, the lower and mid-level spray-arm assemblies 144, 148 and the upper spray assembly 150 may generally form part of a fluid circulation system 152 for circulating fluid (e.g., water and dishwashing fluid which may also include water, detergent, and/or other additives, and may be referred to as wash liquor) within the tub 104. As shown in FIG. 2, the fluid circulation system 152 may also include a recirculation pump 154 located in a machinery compartment 140 below the bottom wall 162 of the tub 104, as is generally recognized in the art, and one or more fluid conduits for circulating the fluid delivered from the pump 154 to and/or throughout the wash chamber 106. The tub 104 may include a sump 142 positioned at a bottom of the wash chamber 106 for receiving fluid from the wash chamber 106. The recirculation pump 154 receives fluid from sump 142 to provide a flow to fluid circulation system 152, which may include a switching valve or diverter (not shown) to select flow to one or more of the lower and mid-level spray-arm assemblies 144, 148 and the upper spray assembly 150.

Moreover, each spray-arm assembly 144, 148 may include an arrangement of discharge ports or orifices for directing washing liquid onto dishes or other articles located in rack assemblies 130 and 132, which may provide a rotational force by virtue of washing fluid flowing through the discharge ports. The resultant rotation of the lower spray-arm assembly 144 provides coverage of dishes and other dishwasher contents with a washing spray.

A drain pump 156 may also be provided in the machinery compartment 140 and in fluid communication with the sump 142. The drain pump 156 may be in fluid communication with an external drain (not shown) to discharge fluid, e.g., used wash liquid, from the sump 142.

The dishwashing appliance 100 may be further equipped with a controller 137 configured to regulate operation of the dishwasher 100. The controller 137 may generally include one or more memory devices and one or more microprocessors, such as one or more general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwashing appliance 100. In the illustrated embodiment, the controller 137 is located within a control panel area 121 of the door 108, as shown in FIG. 1. In such an embodiment, input/output ("I/O") signals may be routed between the control system and various operational components of the dishwashing appliance 100 along wiring harnesses that may be routed through the bottom of the door 108. Typically, the controller 137 includes a user interface panel/control console 136 through which a user may select various operational features and modes and monitor progress of the dishwasher 100. In one embodiment, the control console 136 may represent a general purpose I/O ("GPIO") device or functional block. Additionally, the control console 136 may include input components, such as one or more of a variety of electrical, mechanical or electromechanical input devices including rotary dials, push buttons, touch pads, and touch screens. The control console 136 may also include a display component, such as a digital or analog display device designed to provide operational feedback to a user. As is generally understood, the control console 136 may be in communication with the controller 137 via one or more signal lines or shared communication busses. It should be noted that controllers 137 as disclosed herein are capable of and may be operable to perform any methods and associated method steps as disclosed herein.

It should be appreciated that the present subject matter is not limited to any particular style, model, or configuration of dishwashing appliance. The exemplary embodiment depicted in FIGS. 1 and 2 is simply provided for illustrative purposes only. For example, different locations may be provided for the control console 136, different configurations may be provided for the racks 130, 132, and other differences may be applied as well.

Figure 3:
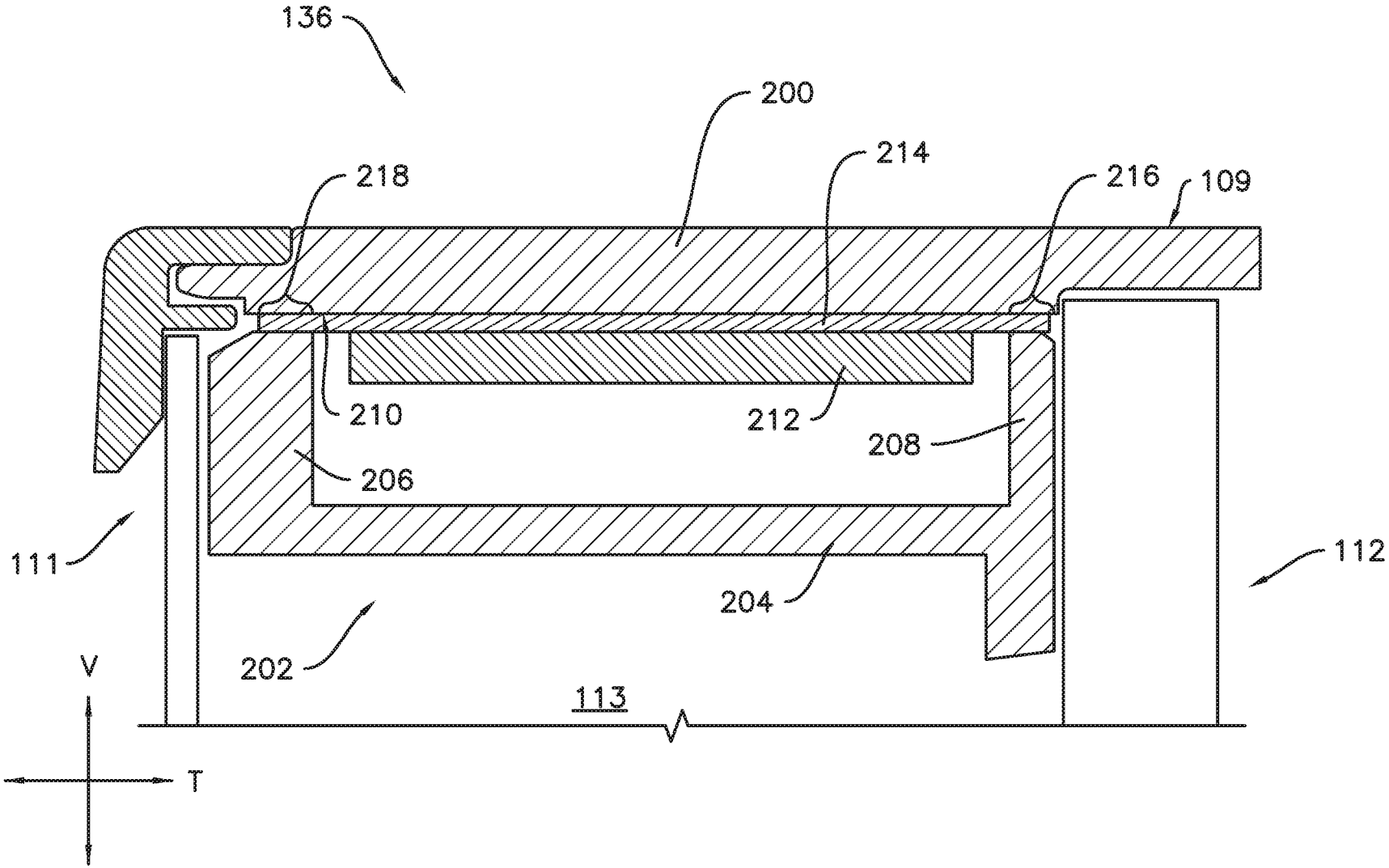
FIG. 3 illustrates a cross-sectional side view of a portion of a door of the dishwashing appliance of FIG. 1 according to one or more embodiments of the present disclosure.

FIG. 3 provides an enlarged view of a portion of the door 108, with the door 108 in the closed position. As illustrated in FIG. 3, the door 108 includes the control console 136 positioned on the door 108 such that the control console 136 forms a portion of an exterior surface 109 of the door 108. As may be seen in FIG. 3, the door 108 extends from a front panel 111 to a back panel 112, e.g., along the transverse direction T when in the closed position as illustrated in FIG. 3. An interior 113 of the door 108 is defined between the front panel 111, the back panel 112, the exterior surface 109, and the bottom 110 (FIG. 2) of the door 108. The control console 136 includes a console cover 200. The console cover 200 is positioned on and at least partially defines the exterior surface 109 of the door 108. The exterior surface 109 generally faces upward along the vertical direction V when the door 108 is in the closed position. For example, the control console 136 may be positioned on a top surface of the door 108, e.g., as illustrated in FIG. 3 where, when in the closed position, the exterior surface 109 is located at an uppermost extent of the door 108 along the vertical direction V.

Still referring to FIG. 3, the control console 136 also includes a console bracket 202 mounted within the interior 113 of the door 108 proximate the console cover 200. For example, the console bracket 202 may be mounted below the console cover 200 along the vertical direction V when the door 108 is in the closed position. The console bracket 202 extends in a first direction, e.g., the transverse direction T when the door 108 is in the closed position as illustrated in FIG. 3, from a front side 206 proximate the front panel 111 of the door 108 to a back side 208 proximate the back panel 112 of the door 108. The console bracket 202 also includes a base 204 extending from the front side 206 to the back side 208. In at least some embodiments, the front side 206 may be joined to the back side 208 through the base 204, whereby the console bracket 202 provides a continuous single structure which can be mounted or mountable to the door 108 (such as at the front and back panels 111 and 112) to support and position the remaining components of the control console 136. The console bracket 202 may be mounted to the door 108 at the front panel 111 and the back panel 112, e.g., the front side 206 of the console bracket 202 may be coupled to the front panel 111, e.g., with one or more mechanical fasteners (not shown) or adhesive, etc. and the back side 208 of the console bracket 202 may also be coupled to the back panel 112 of the door 108, such as with mechanical fasteners, adhesives, or any other suitable coupling as will be understood by those of skill in the art.

The control console 136 may be or include a capacitive touch sensor. For example, the control console 136 may include a printed circuit board 212 comprising one or more capacitive touch sensors embedded thereon, and the console cover 200 may comprise a dielectric material such that the console cover 200 provides a dielectric panel for the capacitive touch sensor(s). For example, as is generally understood by those of skill in the art, the printed circuit board 212 may include an electrode, e.g., a ground pour of the printed circuit board 212, and a sensor pad or pads disposed on the printed circuit board 212. Accordingly, the control console 136 may be responsive to a touch from a user, e.g., on the exterior surface 109, by sensing or measuring a change in capacitance at the printed circuit board 212 due to the presence of, e.g., the user's finger on the exterior surface 109. In various embodiments, the capacitive touch sensor may operate on self capacitance, mutual capacitance, or combinations thereof and/or any other suitable configuration. The structure and function of such capacitive touch sensors are generally understood by those of skill in the art and, as such, are not shown or described in greater detail herein.

The printed circuit board 212 may be attached to the console cover 200 by an adhesive film, e.g., tape, 214, as illustrated in FIG. 3. The adhesive film 214 may be double-sided, e.g., may have adhesive on two opposing surfaces of the film 214. The printed circuit board 212 may be attached to an interior surface 210 of the console cover 200 by the adhesive film 214. The interior surface 210 may, e.g., oppose and face away from the exterior surface 109 of the door 108. It should be noted that the film 214 is illustrated with an exaggerated size relative to the surrounding components in FIG. 3 for the sake of clarity of illustration. In practice, the film 214 may typically be much thinner, e.g., relative to the printed circuit board 212 and the console cover 200, than is depicted in FIG. 3. The printed circuit board 212 may be encompassed within the console bracket 202, e.g., the console bracket 202 may completely surround the printed circuit board 212 on at least three sides. As shown in FIG. 3, the double-sided adhesive film 214 may extend across both the front side 206 and the back side 208 of the console bracket 202. The double-sided adhesive film 214 may also extend between the console bracket 202 and the console cover 200. For example, as illustrated in FIG. 3, the double-sided adhesive film 214 may extend into the console cover to console bracket joint and may contact or engage each of the console cover 200 and the console bracket 202. Thus, the double-sided adhesive film 214 may sealingly engage the console cover 200 and the console bracket 202. As a result of such sealing engagement, the tape or film 214 may form a first seal 218 between the front side 206 of the console bracket 202 and the console cover 200 and may form a second seal 216 between the back side 208 of the console bracket 202 and the console cover 200. The first seal 218 and the second seal 216 may be coplanar, e.g., the adhesive film 214 may be disposed entirely or substantially (e.g., at least 90%) within a single plane, such as along the interior surface 210 of the console cover 200. The first seal 218 and the second seal 216 may reduce or prevent moisture, e.g., water and/or wash liquor, from entering into the console bracket 202, thus avoiding or minimizing interference with the operation of the control console 136. For example, in embodiments where the control console 136 includes capacitive touch sensor(s), short circuits or false touches may be reduced or prevented by the first seal 218 and the second seal 216. Advantageously, providing the first seal 218 and the second seal 216 with the double-sided adhesive film 214 which is used to attach the printed circuit board 212 to the console cover 200 permits sealing between the console cover 200 and the console bracket 202 without additional parts and with a relatively simple construction.

The control console 136 of the present disclosure provides several advantages. For example, forming the seals 216 and 218 between the console bracket 202 and the console cover 200 with the double-sided adhesive film 214 which attaches the printed circuit board 212 to the console cover 200 provides a sealing engagement between the console bracket 202 and the console cover 200 without needing the console bracket 202 to extend beyond the interior surface 210 of the console cover 200, e.g., along the vertical direction V when the door 108 is in the closed position. Accordingly, the console cover 200 may provide a smooth and uninterrupted surface for user engagement, e.g., a smooth and uninterrupted touch surface of the capacitive touch sensor in at least some embodiments. Such uninterrupted surface may be advantageous at least in aesthetics and may also reduce the possibility of debris accumulation on the control console 136, e.g., by reducing the number and size of seams or crevasses in which debris may accumulate. As another example, such design may reduce the overall number of parts in the control console 136 assembly, e.g., by eliminating a need for additional separate sealing components. Accordingly, the printed circuit board 212 may be larger and may thereby provide increased size of the touch surface, e.g., in some embodiments a larger portion of the top surface 109 of the door 108 may be usable as the touch surface than would be possible if additional sealing elements were included. For example, the console cover 200, including the touch-responsive exterior surface 109 defined thereby, may extend from the front panel 111 of the door 108 to the back panel 112 of the door 108. As another example, the console bracket 202 may be positioned entirely within the interior 113 of the door 108, e.g., without extending to or forming a part of the exterior surface 109 of the door 108.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwashing appliance, comprising:

a cabinet;

a tub in the cabinet, the tub defining a wash chamber for receipt of articles for washing;

a door rotatably mounted to the cabinet for movement between a closed position wherein the wash chamber is sealingly enclosed and an open position permitting access to the wash chamber for loading and unloading of articles from the dishwashing appliance; and a control console positioned on the door, the control console comprising a console cover on an exterior surface of the door, a console bracket mounted within an interior of the door and proximate the console cover, and a circuit board attached to an interior surface of the console cover with a double-sided adhesive film, wherein the double-sided adhesive film sealingly engages the console cover and the console bracket.

2. The dishwashing appliance of claim 1, wherein the console bracket extends from a front side to a back side with the circuit board encompassed within the console bracket, and wherein the adhesive film extends from the front side of the console bracket to the back side of the console bracket.

3. The dishwashing appliance of claim 2, wherein the door comprises a front panel and a back panel, the front side of the console bracket coupled to the front panel of the door and the back side of the console bracket coupled to the back panel of the door.

4. The dishwashing appliance of claim 1, wherein the double-sided adhesive film forms a first seal between a front side of the console bracket and the console cover and forms a second seal between a back side of the console bracket and the console cover.

5. The dishwashing appliance of claim 1, wherein the control console comprises a capacitive touch sensor.

6. The dishwashing appliance of claim 1, wherein the door comprises a front panel and a back panel, and wherein the console cover extends from the front panel of the door to the back panel of the door.

7. The dishwashing appliance of claim 1, wherein the console bracket is positioned entirely within the interior of the door.

8. The dishwashing appliance of claim 1, wherein the console bracket does not form a part of the exterior surface of the door.

9. The dishwashing appliance of claim 1, wherein the control console is positioned on a top surface of the door.

10. A dishwashing appliance, comprising:

a cabinet defining a vertical direction, a lateral direction, and a transverse direction that are mutually perpendicular;

a tub in the cabinet, the tub defining a wash chamber for receipt of articles for washing;

a door rotatably mounted to the cabinet for movement between a closed vertical position wherein the wash chamber is sealingly enclosed and an open position permitting access to the wash chamber for loading and unloading of articles from the dishwashing appliance; and a control console positioned on the door, the control console comprising a console cover on an exterior surface of the door, the exterior surface of the door facing upward along the vertical direction when the door is in the closed position, the control console further comprising a console bracket mounted within an interior of the door and below the console cover along the vertical direction when the door is in the closed position and a circuit board attached to an interior surface of the console cover with a double-sided adhesive film, wherein the double-sided adhesive film sealingly engages the console cover and the console bracket.

11. The dishwashing appliance of claim 10, wherein the console bracket extends from a front side to a back side along the transverse direction when the door is in the closed position, wherein the circuit board is encompassed within the console bracket, and wherein the adhesive film extends from the front side of the console bracket to the back side of the console bracket.

12. The dishwashing appliance of claim 11, wherein the door comprises a front panel and a back panel which are spaced apart along the transverse direction when the door is in the closed position, the front side of the console bracket coupled to the front panel of the door and the back side of the console bracket coupled to the back panel of the door.

13. The dishwashing appliance of claim 10, wherein the double-sided adhesive film forms a first seal between a front side of the console bracket and the console cover and forms a second seal between a back side of the console bracket and the console cover.

14. The dishwashing appliance of claim 10, wherein the control console comprises a capacitive touch sensor.

15. The dishwashing appliance of claim 10, wherein the door comprises a front panel and a back panel which are spaced apart along the transverse direction when the door is in the closed position, and wherein the console cover extends from the front panel of the door to the back panel of the door.

16. The dishwashing appliance of claim 10, wherein the console bracket is positioned entirely within the interior of the door.

17. The dishwashing appliance of claim 10, wherein the console bracket does not form a part of the exterior surface of the door.

18. The dishwashing appliance of claim 10, wherein the control console is positioned on a top surface of the door.

* * * * *